United States Patent [19]

Knighton et al.

[11] 4,357,488

[45] Nov. 2, 1982

[54] VOICE DISCRIMINATING SYSTEM

[75] Inventors: Mark S. Knighton, Los Angeles; Charles H. Fuller, Torrance; Anson Sims, Granada Hills; Ashley G. Howden, Los Angeles; L. C. James Kingsbury, Fountain Valley; Lawrence T. Jones, Playa Del Rey, all of Calif.

[73] Assignee: California R & D Center, Culver City, Calif.

[21] Appl. No.: 109,596

[22] Filed: Jan. 4, 1980

[51] Int. Cl.[3] ..... G10L 1/00

[52] U.S. Cl. ..... 179/1 SC; 179/1 VC

[58] Field of Search ..... 179/1 VC, 1 VE, 1 HF, 179/1 AT, 1 GQ, 1 CN, 1 P, 1 SC; 273/237; 434/321; 367/99; 340/148, 323; 307/116

[56] References Cited

U.S. PATENT DOCUMENTS

| | | | |
|---|---|---|---|
| 2,787,736 | 4/1957 | Ellison et al. | 179/1 GQ |
| 3,626,365 | 12/1971 | Press et al. | 179/1 VE |
| 3,688,126 | 8/1972 | Klein | 179/1 VC |
| 3,992,590 | 11/1976 | Takahashi et al. | 179/1 GQ |
| 3,999,015 | 12/1976 | Snyder et al. | 179/1 VE |
| 4,090,032 | 5/1978 | Schrader | 179/1 CN |

*Primary Examiner*—Errol A. Krass
*Assistant Examiner*—E. S. Kemeny
*Attorney, Agent, or Firm*—Jackson, Jones & Price

[57] ABSTRACT

A voice discriminating system is disclosed which includes input circuitry for a pair of microphones, circuitry for detecting the presence of voiced sounds inputted to the microphones, selectively enabled circuitry for detecting the presence of unvoiced sounds inputted to the microphones, and a microcontroller which executes functions under the control of the presence or absence of voiced or non-voiced sounds inputted to the microphones. The disclosed system further includes a display circuit and a sound circuit that are controlled by the microcontroller for the purpose of playing games wherein the players provide spoken commands to the microphones.

9 Claims, 7 Drawing Figures

VOICE DISCRIMINATING SYSTEM

BACKGROUND OF THE INVENTION

The disclosed invention relates to a voice discriminating system and is particularly embodied in a game apparatus that is voice-controlled.

There are prior art devices that are intended for discriminating between words such as "YES" and "NO" and for providing outputs indicative of the nature of the spoken sounds. For example, U.S. Pat. No. 3,688,126, issued to Klein on Aug. 29, 1972, discloses apparatus that is sound operated.

However, prior art devices have the major disadvantage of lacking accuracy and consistency in discriminating between voiced sounds (such as the word "NO") and voiced sound followed by unvoiced sound (such as the word "YES"). Moreover, none of the prior art devices are directed to sound inputs provided by two or more persons especially sounds which may partially overlap. Also, prior art devices lack sufficient dynamic range to be useful in an environment where a large amount of background noise is present. Further, prior art devices generally have to be adjusted for background noise.

Also, there are prior art devices that are controlled by sound. However, such prior art devices are generally responsive to the presence or absence of sound, and are not responsive to the nature of the sound. For example, such prior art devices may be responsive to a handclap or similar noise.

It is therefore an object of the subject invention to provide a voice discriminating system that is accurate and consistent.

A further object of the disclosed invention is to provide a voice discriminating system that has high immunity to background noise and has a large dynamic range.

Still another object of the invention is to provide a voice discriminating system that discriminates between sounds spoken by two or more persons.

Another object of the invention is to provide a voice discriminating system that is responsive to voiced and non-voiced sounds spoken by two or more persons and selects the sounds provided by the person who was first to speak.

A further object of the invention is to provide a voice discriminating system that can be used to control a game apparatus.

Another object of the invention is to provide a voice discriminating system that identifies which of two players was first to speak, and also identifies whether the spoken sound was, for example a "YES" or a "NO".

An object of the disclosed invention is also to provide a voice discriminating system that is responsive to predetermined sequences of voiced and non-voiced sounds.

SUMMARY OF THE INVENTION

The foregoing and other objects of the invention are accomplished by the disclosed system which includes circuitry for analyzing voiced inputs provided to a pair of microphones. Signals representative of the sound inputs to the microphones are filtered and compared for determination of which input contained low frequency components of greater magnitude. A VOX output is provided indicating which microphone was first to provide an input having low frequency components of greater magnitude. The microphone input which is associated with the VOX output is subsequently sampled for high frequency content and an output is provided to indicate the presence of such high frequency components. A microcontroller is adapted to respond to the VOX output and the output indicative of high frequency content, and provides signals indicative of which sound input was selected for processing and the nature of the sound input selected. The microcontroller utilizes these signals to control and execute game functions, and to provide appropriate control signals to a sound circuit and a display circuit.

BRIEF DESCRIPTION OF THE DRAWING

The various objects, advantages and features of the disclosed invention will be readily apparent to those skilled in the art from the following detailed disclosure and claims when read in conjunction with the accompanying drawing wherein:

DETAILED DESCRIPTION OF THE DISCLOSURE

Figure 1:
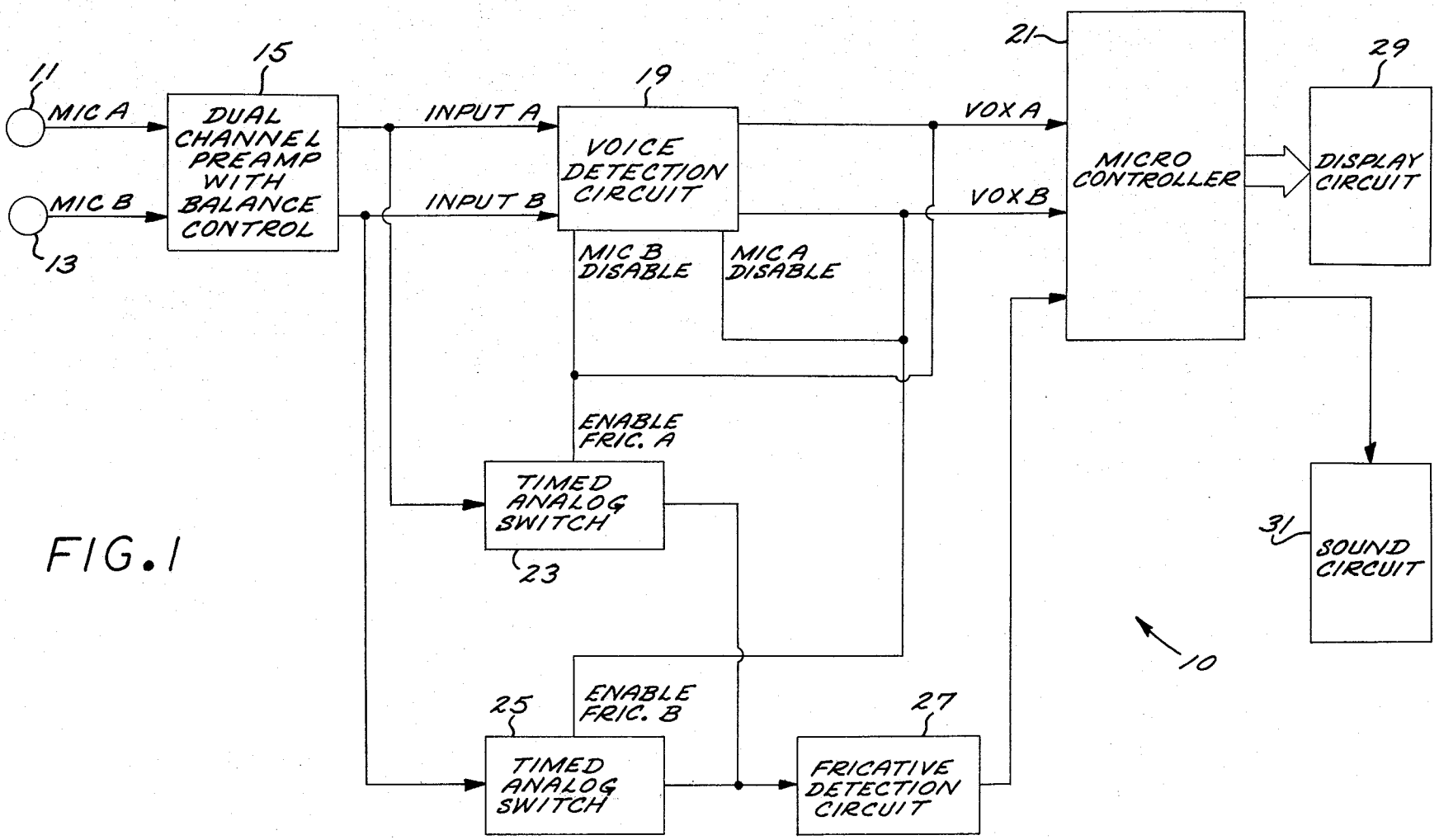
FIG. 1 is a circuit block diagram of the disclosed voice discriminating system.

Referring now to FIG. 1, the disclosed voice discriminating system, generally designated by the reference numeral 10, includes a pair of microphones 11 and 13 which are responsive to sound inputs from players A and B, respectively. The microphones 11 and 13 should be physically separated and should be facing away from each other for improved player discrimination. The outputs of the microphones 11 and 13 are applied to a dual channel microphone preamplifier 15. The preamplifier 15 includes a balance control and provides amplified electrical signals INPUT A and INPUT B indicative of the inputs to the microphones 11 and 13, respectively. The preamplifier 15 may include appropriate filters, such as bandpass filters, for controlling the frequency content of signals INPUT A and INPUT B. These amplified signals are applied to a voice detection circuit 19 which processes the inputs provided by the preamplifier and provides as outputs signals indicative of whether player A (VOX A) or player B (VOX B) made a sound into the respective microphones 11 or 13 which was recognized by the voice detection circuit 19 as being the sound of a player's voice. As discussed more fully herein, the outputs VOX A or VOX B of the voice detection circuit 19 indicate which player was first to speak. Further, the outputs VOX A and VOX B of the voice detection circuit 19 are utilized to control the operation of the voice detection circuit 19 and the selective closing of a timed analog switch 23 and a timed analog switch 25.

Particularly, the voice detection circuit 19 provides the VOX A signal when a voice associated with player A is detected. The VOX A signal is provided as the ENABLE FRICATIVE A signal to the timed analog switch 23 to enable that switch. Also, the VOX A signal is provided as the MIC B DISABLE signal to the voice detection circuit 19 to disable the processing of any INPUT B signals provided by the dual channel preamplifier 15 which are associated with player B.

Similarly, when the voice of player B is first detected, the voice detection circuit 19 provides the VOX B signal. The VOX B signal is applied as an ENABLE FRICATIVE B signal to enable the timed analog switch 25. The VOX B signal is further utilized by the voice detection circuit 19 as a MIC A DISABLE signal to disable the processing of any INPUT A signals provided by the dual channel preamplifier 15.

Thus, it should be apparent that the voice detection circuit functions to detect the sound provided by the player who was first to speak, and further selects the appropriate input signal (INPUT A or INPUT B) for further processing. It should also be apparent that the micro-controller 21 could also be utilized to provide the MIC B DISABLE, ENABLE FRICATIVE A, MIC A DISABLE, and ENABLE FRICATIVE B signals, if desired. However, using the VOX A and VOX B outputs to provide these signals is simple and effective.

The timed analog switch 23 and the timed analog switch 25 are normally open switches which are closed on the trailing edge of the appropriate ENABLE signals from the voice detection circuit 19. Each timed analog switch 23 and 25 includes timing circuitry, such as an RC discharge circuit, which maintains the analog switch closed for a predetermined amount of time after the switch is closed. Thus, the analog switches 23 and 25 effectively sample the outputs of their associated amplifiers 15 and 17 during an interval that starts after the trailing edge of a VOX A or VOX B output, produced by the voice detection circuit 19.

The sampled signals INPUT A or INPUT B provided by the dual channel preamplifier 15 through respective timed analog switches 23 or 25 are applied to a fricative detection circuit 27. The fricative detection circuit 27 analyzes the sampled signals for frequency content, and provides a fricative signal indicative of the presence of an unvoiced sound spoken by the player whose microphone input (as represented by INPUT A or INPUT B) has been sampled.

It should be pointed out that the term "fricative" is used herein as a broad designation for an unvoiced spoken sound. Thus, the fricative detection circuit 27 is responsive to frequency content of unvoiced spoken sounds, such as the "S" at the end of the "YES".

The microcontroller 21 functions to control a display circuit 29 in response to the control provided by the VOX A and VOX B signals from the voice detection circuit 19, and by the fricative signal from the fricative detection circuit 27. The display circuit 29 includes a display driver (not shown) responsive to the microcontroller 21, and visual display elements (not shown) such as red and green LED's. For example, the National Semiconductor MM5450 integrated circuit is an appropriate display driver. The visual display elements provide to the players visual indications of the nature of the game being played, the progress and status of the game being played, the score of the game being played, as well as other visible procedures such as pregame and postgame light shows.

As contemplated herein, the display circuit 29 includes pairs of red and greed LED's, which pairs are arranged in circular fashion in a circular housing. The contemplated games, are selected according to the position of selectively enabled LED's and the nature of the sounds, if any, that are detected by the voice detection circuit 19 and the fricative detection circuit 27. Similarly, control and play of the game being played will be a function of the position of the enabled LED's, the detection of a voice from one of the players and the nature of the sound of that voice (i.e. whether a voiced sound of short duration was followed by an unvoiced sound), and which player first provided the control sound. In response to signals provided by the voice detection circuit 19 and the fricative detection circuit 27, the microcontroller 21 appropriately proceeds with the game selected and further controls the progress of the selected game in accordance with such inputs.

The voice-controlled apparatus 10 further includes a sound circuit 31 which is controlled by the microcontroller 21. The sound circuit 31 includes a transducer, such as a piezo-ceramic speaker, and circuitry for driving the transducer. The microcontroller 21 controls the sound circuit to provide game sounds as well as sounds to accompany the selective enabling of the visual display elements in the display circuit 29.

Figure 2:
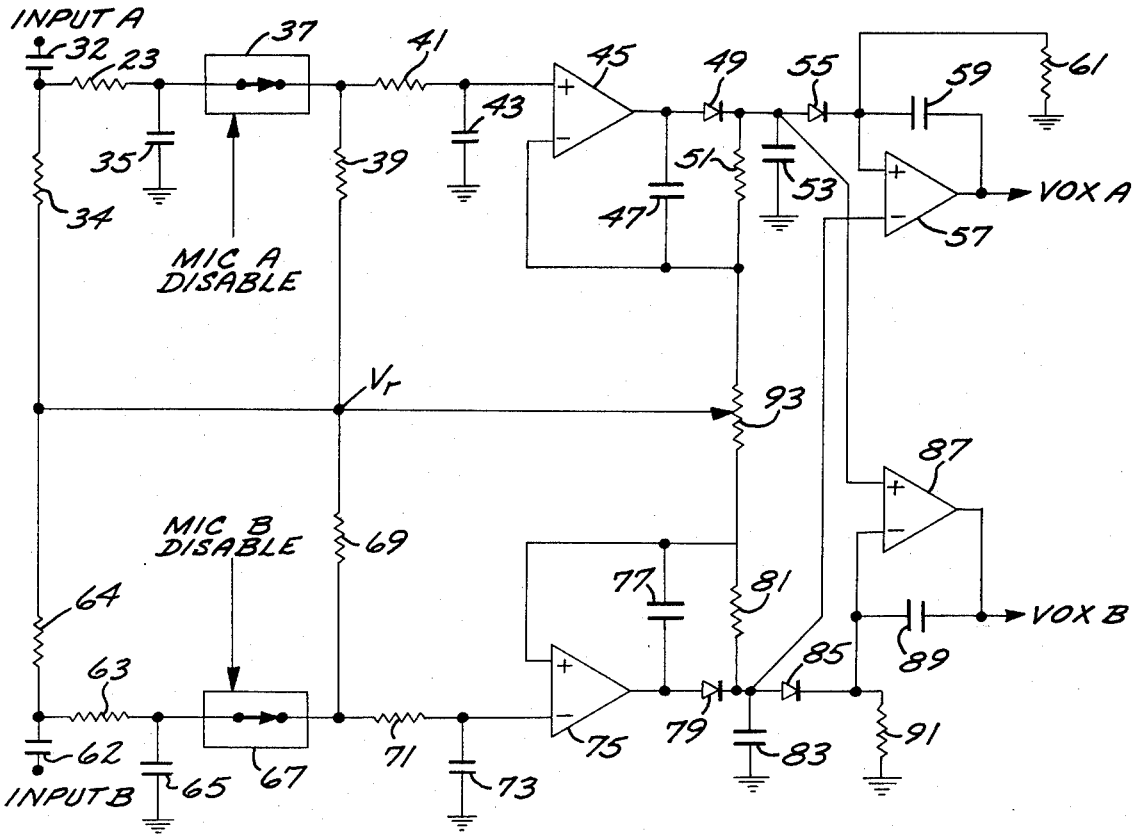
FIG. 2 is a circuit schematic of the voice detection circuit shown in FIG. 1.

FIG. 2, discloses a particular embodiment of the voice detection circuit 19 which was generally described in the above. The output from the amplifier 15 is provided through a coupling capacitor 32 to one terminal of an input resistor 33 which has its other terminal coupled to a capacitor 35 and an analog switch 37. A resistor 34 is coupled between the coupling capacitor 32 and a reference level $V_r$. The capacitor 35 is also coupled to a ground reference level, and along with the resistor 33 forms a low pass filter. The analog switch 37 is a normally closed switch which is selectively opened by application of the control signal MIC A DISABLE to its gate. The remaining terminal of the analog switch 37 is coupled to resistors 39 and 41. The resistor 39 is also coupled to a reference node to which a reference voltage $V_r$ is applied. The resistor 41 and coupled to a capacitor 43, and these elements together form another low pass filter. The resistor 41 is further coupled to the non-inverting input of an operational amplifier 45. The output of the operational amplifier 45 is coupled to a feedback capacitor 47 and a peak detecting diode 49. Specifically, the feedback capacitor 47 is interposed between the output of the operational amplifier 45 and its inverting input. The cathode of the diode 49 is coupled to one end of a resistor 51 which has its other end connected to the inverting input of the operational amplifier 45. An integrating capacitor 53 is coupled between ground reference level and the cathode of the diode 49.

The signal provided at the non-grounded end of the capacitor 53 is indicative of the positive peak envelope of the low frequency voice signal provided to the input of the operational amplifier 45. Particularly, the signal on the capacitor 53 is a continuous filtered signal so that short breaks in the sound input to the microphone 11 (as represented by the INPUT A) do not prevent the sound from being detected.

The non-grounded end of the capacitor 53 is coupled to a diode 55 which in turn has its cathode coupled to the inverting input of an operational amplifier 57. The diode 55 serves to prevent signals at the inverting input of the operational amplifier 57 from distorting the charge on the capacitor 53. A feedback capacitor 59 is interposed between the output of the operational amplifier 57 and its inverting input. A resistor 61 is coupled between ground and the inverting input of the operational amplifier 57. The capacitor 59 and the resistor 61 serve to control the decay of the output provided by the operational amplifier 57 after the capacitor 53 has discharged below a threshold level. That prevents multiple VOX A signals from occurring during a single spoken command. The output of the operational amplifier 57 is the VOX A signal indicative of the presence of a detected voiced sound.

The INPUT B signal (which is associated with player B) is applied to circuitry that is similar to the circuitry described above with respect to FIG. 2. Specifically, referring still to FIG. 2, the INPUT B signal provided by the dual-channel preamplifier 15 is applied through a coupling capacitor 62 to one end of a resistor 63 which has its other end connected to a capacitor 65, which is coupled between the resistor 63 and ground reference level. A resistor 34 is coupled between the coupling capacitor 32 and the reference level $V_r$. The resistor 63 and the capacitor 65 form a low pass filter. The non-grounded end of the capacitor 65 and one end of the resistor 63 are commonly connected to an analog switch 67 which is a normally closed switch that can be opened by application of the appropriate control signal MIC B DISABLE to its gate. As discussed previously, the MIC B DISABLE signal is provided by the VOX A output. The controlled output of the analog switch 67 is coupled to a resistor 69 which is interposed between the analog switch 67 and the reference node having reference voltage $V_r$. The controlled output of the analog switch 67 is also applied to a resistor 71 which in turn is coupled to a grounded capacitor 73. The resistor 71 and the capacitor 73 form a low pass filter.

The low pass signal at the non-grounded end of the capacitor 73 is applied to the non-inverting input of an operational amplifier 75. A feedback capacitor 77 is coupled between the output of the operational amplifier 75 and its inverting input. The output of the operational amplifier 75 is also coupled to the anode of a peak detecting diode 79 which has its cathode connected to a resistor 81. One end of the resistor 81 is commonly connected with one end of the capacitor 77 to the inverting input of the operational amplifier 75. An integrating capacitor 83 is connected between the cathode of the diode 79 and ground reference level. The signal on the non-grounded end of the capacitor 83 is a continuous filtered signal indicative of the positive peak envelope of the low-pass components of the voiced input to the microphone 13. The peak detection and integration functions prevent short breaks in the sound input represented by the INPUT B signal from causing the sound input to not be detected.

The anode of a diode 85 is coupled to the non-grounded end of the capacitor 83, and the cathode of the diode 85 is connected to the inverting input of an operational amplifier 87. The diode 85 is to prevent signals at the input of the operational amplifier 87 from erroneously charging the capacitor 83. A feedback capacitor 89 is coupled between the output of the operational amplifier 87 and its inverting input. A resistor 91 is coupled between ground reference level and the inverting input of the operational amplifier 87. The capacitor 89 and the resistor 91 serve to control the decay time of the output provided by the operational amplifier 87 after the capacitor 73 has discharged below a threshold LEVEL. The output of the operational amplifier 87 is the VOX B signal which is indicative of the presence of a detected voiced sound.

The input to the non-inverting input of the operational amplifier 87 is provided by the electrical signal present at the common node between the capacitor 53 and the diode 55. Similarly, the input to the non-inverting input of the operational amplifier 57 is provided by the electrical signal at the common node between the capacitor 83 and the diode 85. Thus, it should be apparent that the outputs of the operational amplifier 87 (VOX A) and 87 (VOX B) will be a function of the difference in the magnitudes of the respective integrated charge values on the capacitors 53 and 83 which are respectively associated with players A and B. In order to balance the outputs VOX A and VOX B, a balancing resistor 93 is provided between the inverting inputs of the operational amplifiers 45 and 75. The wiper terminal of the balancing resistor 93 is coupled to the reference node having reference voltage $V_r$.

As disclosed in FIG. 2, each of the operational amplifiers 57 and 87 functions as a differential comparator. As is also shown in FIG. 2, diodes provide the inputs to the non-inverting inputs to the operational amplifiers 57 and 87. Thus, it should be apparent that for a VOX signal to be provided, a particular voice input as represented on one of the capacitors 53 or 83 must exceed the other voice input as represented on the other of capacitors 53 or 83 by at least one diode voltage drop. It should also be pointed out that the presence of a VOX signal will cause all inputs to the other channel to be cut out, as described previously. Thus, the operational amplifier that is providing a VOX signal will turn off at a lower signal threshold than the threshold that was required to turn it on.

Figure 3:
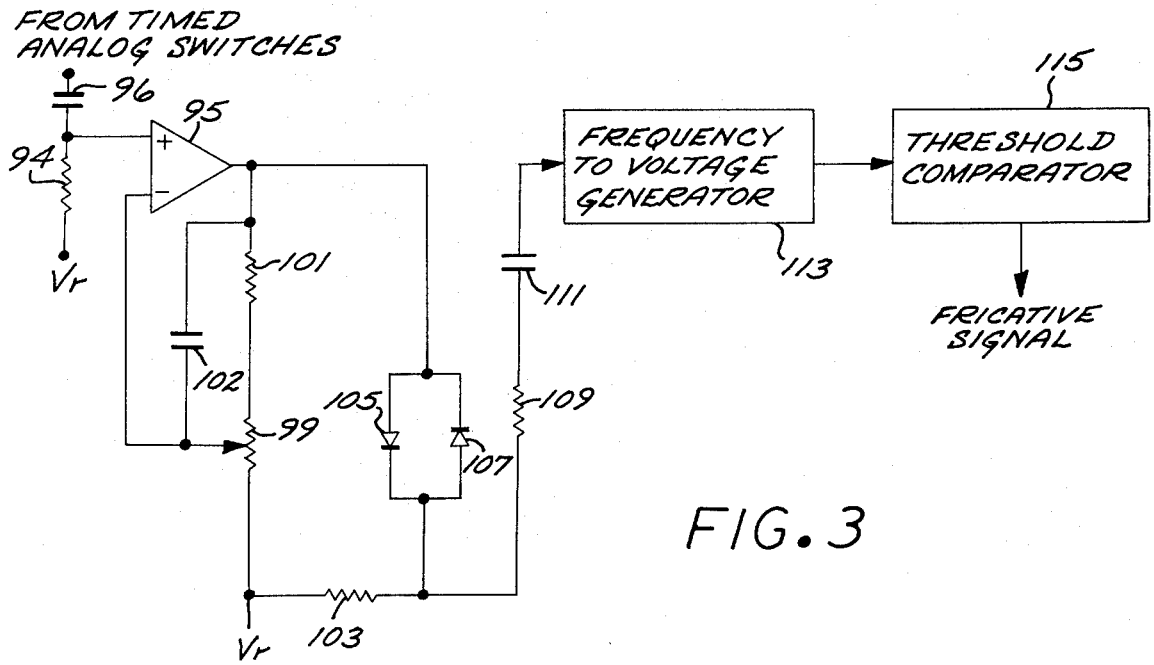
FIG. 3 is a circuit schematic of the fricative detection circuit shown in FIG. 1.

FIG. 3 discloses a particular embodiment of the fricative detection circuit 27. The outputs from the timed analog switches 23 and 25 (FIG. 1) are applied through a coupling capacitor 96 to the non-inverting input of an operational amplifier 95. A resistor 94 is coupled between the non-inverting input of the operational amplifier 95 and the reference level $V_r$. The inverting input of the operational amplifier 95 is coupled to the wiper element of an adjustable resistor 99 which has its two other terminals coupled to resistors 101 and 103. A feedback capacitor 105 is coupled between the output of the operational amplifier 95 and its inverting input. The node between the resistor 103 and the resistor 99 is connected to the reference level $V_r$. The resistor 103 has one end connected to a reference node which is as the reference level $V_r$ which was discussed previously in conjunction with FIG. 2. Further, a pair of diodes 105 and 107 are interposed between the output of the operational amplifier 95 and the resistor 103. The diodes 105 and 107 function to reduce low level noise from the output of the operational amplifier 95. Also, the variable resistor 99 is used to set the gain of the output of the operational amplifier 95 to optimize high frequency signal to noise ratios.

A resistor 109 has one end coupled to the common node between the resistor 103 and the diodes 105 and 107. The other end of the resistor 109 is coupled to one end of a coupling capacitor 111 which has its other terminal connected to a frequency to voltage generator 113. The output of the frequency to voltage generator 113 is applied to a threshold comparator 115. The purpose of the comparator 115 is to provide the appropriate logic levels associated with the output of the frequency to voltage generator 113. This is due to the fact that the output of the frequency to voltage generator 113 is continuous during the presence of a sampled fricative, and the comparator 115 provides its logic level outputs as a function of whether the output of the frequency to voltage generator 113 is above or below a predetermined threshold. An example of an integrated circuit that includes both a frequency to voltage generator and a threshold comparator is the National Semiconductor LM2917-8. That integrated circuit can be adopted with appropriate external capacitors and resistors to achieve the desired frequency and voltage characteristics.

As is readily apparent, the fricative detection circuit 21 (FIG. 1) is provided an input only after a sound input has been detected and selected by the voice detection circuit 19. Thus, the fricative signal provided by the threshold comparator 115 (FIG. 3) is indicative of the presence or absence of any unvoiced fricative that follows a non-fricative sound of short duration. For example, if player A says the word "YES" the amplifier 57 (FIG. 2) will provide a VOX A signal indicative of detection of a sound from player A; and the frequency to voltage generator 113 (FIG. 3) will provide to the microcontroller a fricative signal indicative of the unvoiced spoken sound at the end of the word "YES".

It should be pointed out that the microcontroller 21 prevents a player who maintains a continuos VOX output from providing a valid control command since the microcontroller 21 will ignore a VOX output that lasts longer than a predetermined short duration. Thus, although a player can disable an opponent's microphone input by continuously providing sounds, such a player effectively disables the processing of his own voice.

For purposes of economy and simplicity, the frequency to voltage generator 113 and the threshold comparator 115 could be replaced with an integrator. However, it should be pointed out that an integrator would substantially decrease the performance of the fricative detection circuit 27.

The microcontroller 21 shown in FIG. 1 may be one of readily available integrated circuits, such as those included in the COP 400 series of single-chip microcontrollers available from National Semiconductor.

Figure 4:
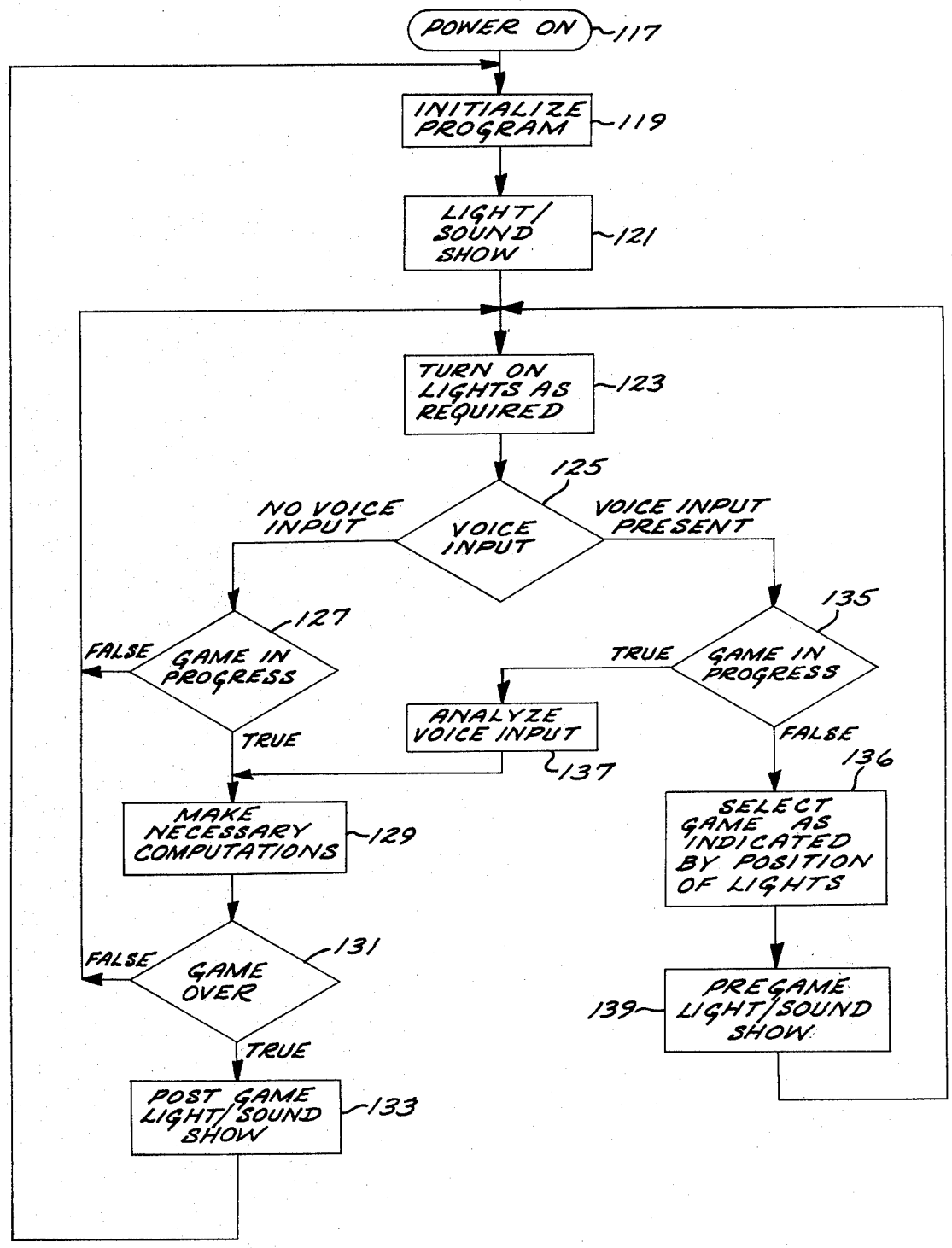
FIG. 4 is a flow chart showing in exemplary form a sequence of the general functions performed by the microcontroller shown in FIG. 1.

The functions generally performed by the microcontroller 21 (FIG. 1) are shown in the flow chart of FIG. 4. Particularly, the functions performed by the microcontroller 21 begin after the power is turned on, as indicated by the POWER ON function indicated in the block 117. Subsequently, the internally stored program for executing the microcontroller functions is initialized as shown by the INITIALIZE PROGRAM block 119. After the program is initialized, a short light and sound show is provided by the microcontroller 21 through the display circuit 29 and the sound circuit 31, as indicated by the LIGHT/SOUND SHOW block 121. After the light and sound show, the visual dislay element in the display circuit 29 are appropriately turned on as indicated by the flow chart block 123. The microcontroller then examines its inputs to determine whether a voice input is present, as indicated by the presence of the VOX A or VOX B signals from the voice detection circuit 19. That decision is indicated in the VOICE INPUT decision block 125.

The negative response to the decision shown in block 125 will first be discussed. The next function is to determine whether a game is in progress, as indicated in a decision block 127. If a game is not in progress, the microcontroller goes back to execute the functions identified by the block 123, which is to appropriately turn on the visual display elements of the display circuit 29. If the decision of the block 127 is that a game is in progress, the microcontroller will proceed to make the necessary computations required by the game in progress, as shown by the block 129. After the computations are made, a decision is made as to whether the game is over, as indicated by the decision block 131. If the game is not over, the functions identified by the block 123 which indicates that the display elements of the display circuit 29 will be appropriately turned on. If, however, the game is over, then the function of providing a post-game light and sound show is carried out as indicated by the flow chart block 133. After the post game light and sound show, control of the functions carried out by the microcontroller 21 is returned to the INITIALIZE PROGRAM flow chart block 119.

Returning now to the VOICE INPUT decision block 125, if the condition is answered affirmatively, then another decision must be made as to whether the game is in progress, as indicated by a decision block 135. If a game is in progress, then the next function carried out by the microcontroller is to analyze the voice input, as shown by the flow chart function block 137. After the voice input has been analyzed, then control of the functions returns to the flow chart function block 129 which indicates that the necessary computations for the control of the game in progress are made.

If the condition found in accordance with the decision block 135 is that a game is not in progress, then the next function carried out by the microcontroller 21 is to select the game which is indicated by the position of the illuminated visual elements in the display circuit 29 at the time that a voice input was detected. The function of game selection is identified by the flow chart function block 136. After the game selection function is completed, the microcontroller provides a pregame light show as indicated by the flow chart function block 139. After the pregame light show, control is returned to the flow chart function block 123 which will turn on the appropriate visual elements of the display circuit 29.

Figure 5:
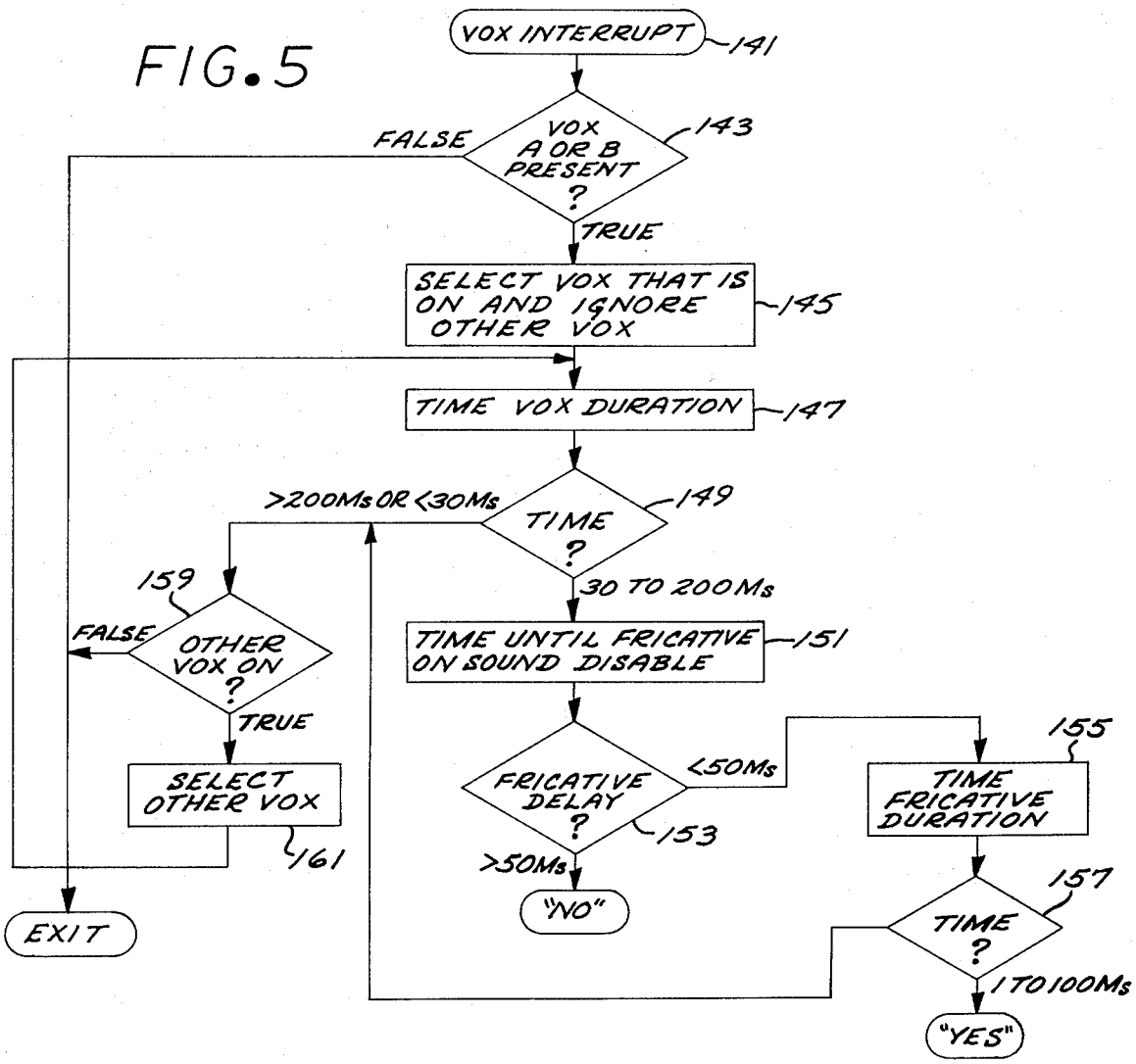
FIG. 5 is a flow chart showing the sequence of functions performed by the microcontroller, shown in FIG. 1, for analyzing the outputs provided by the voice detection circuit and the fricative detection circuit.

Referring now to FIG. 5, there is shown a flow chart of the particular functions performed by the microcontroller 21 in analyzing the voice input as generally shown by the flow chart function block 137 in FIG. 4. Particularly, the presence of either of the VOX A or VOX B signals causes a VOX interrupt as indicated by the entry block 141. It should be noted that instead of an interrupt the outputs provided by VOX A and VOX B could be polled. The next function is to decide whether a VOX A or VOX B signal is present, as indicated by the decision block 143. If neither VOX A or VOX B is present, the subroutine will exit. However, if either VOX A or VOX B is present, the microcontroller will select the VOX that is on and ignore the other VOX until the other VOX is selected, if at all. This function is indicated in the function block 145. As shown by a function block 147, the next function is to time the duration of the VOX that has been selected. A decision is then made, as indicated by the decision block 149, as a function of the duration of the VOX selected. The decision branch for a valid VOX of duration between 30 and 200 milliseconds will be first discussed. The time delay between the end of the VOX selected and the start of any fricative signal provided by the fricative detection circuit 27 is then measured, as shown by the flow chart function block 151. A decision is then made based upon the time of the fricative delay, as shown by the decision block 153. If the delay is greater than 50 milliseconds, then the subroutine provides an output indicating that the selected VOX was a "NO" and exits. If the fricative delay is greater than 50 milliseconds, then the duration of the fricative signal output is timed, as indicated by the function block 155. A decision is then made based upon the time duration of the fricative signal output, as indicated by the decision block 157. If the fricative signal duration is between 1 and 100 milliseconds, then the subroutine provides an output indicative of a "YES". However, if the duration of the fricative signal is less than one millisecond or is greater than one hundred milliseconds, the subroutine branches to a decision block 159 which determines whether the non-selected VOX is on.

It should be noted that the decision block 159 is also one of the branches from the decision block 149. Specifically, if the selected VOX duration, which was measured in accordance with the function block 147, is greater than 200 milliseconds or is less than 30 milliseconds, then the decision provided by the decision block 149 will branch to the decision block 159. If the non-selected VOX is not on, then the subroutine will exit. However, if the non-selected VOX is on, then that VOX is selected for further processing, as indicated by the function block 161.

Figure 6:
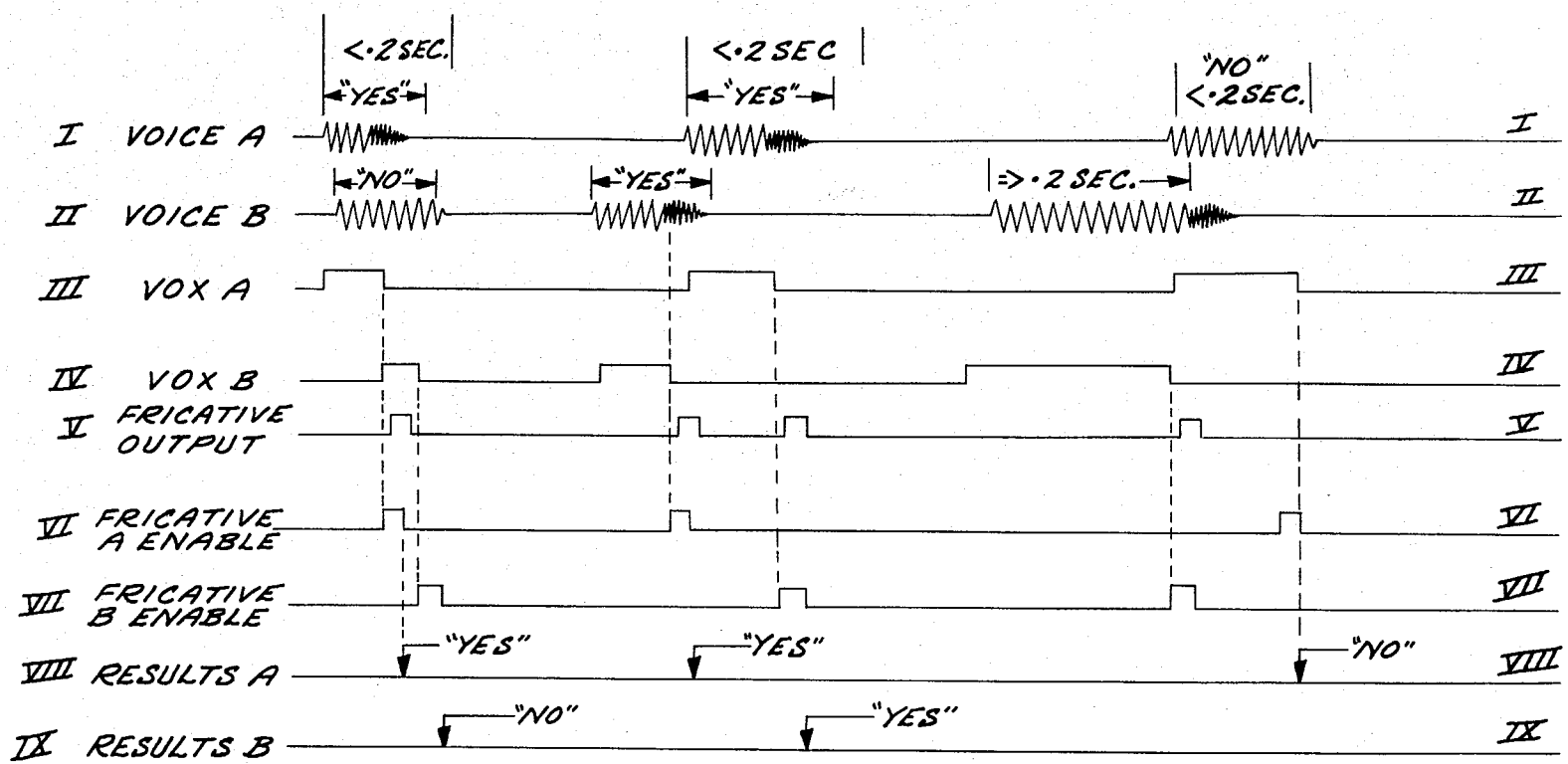
FIG. 6 is a timing diagram showing waveforms generated by the voice discriminating system for exemplary spoken sound inputs.

FIG. 6 is a timing diagram that illustrates in exemplary form the waveforms associated with the various signals referred to in the above disclosure. Particularly, the waveform identified by the reference numeral I is the waveform associated with a VOICE A. The waveform identified by the reference numeral II is the waveform associated with a VOICE B. The waveform identified by the reference numeral III is the VOX A output associated with the inputs provided by VOICE A, as shown above in the waveform identified by the reference numeral I. The waveform identified by the reference numeral IV is the VOX B output associated with the input provided by the VOICE B as shown in the waveform identified by the reference numeral II. The waveform identified by the reference numeral V is the fricative output that is caused to be provided by the inputs VOICE A and VOICE B. The waveform identified by the reference numeral VI shows the waveform of the FRICATIVE A ENABLE signals that are generated as a result of the VOX A signals. The waveform identified by the reference numeral VII is the FRICATIVE B ENABLE signal that is provided as a result of the VOX B signal shown in the waveform identified by the reference numeral IV. The waveforms identified by the reference numerals VIII and IX indicate the respective results for VOICE A and VOICE B provided by the microcontroller 21 in response to the VOX A, VOX B, and fricative signals which are provided as shown in the waveforms identified by the reference numerals III, IV, and V.

Referring now to the left most situation shown in FIG. 6, VOICE A says "YES" slightly before VOICE B says "NO". That situation illustrates that where there is partial overlap between the voice inputs, disclosed circuitry is capable of discriminating the nature of the two voiced inputs. The results are shown in the waveforms identified by reference numerals VIII and IX.

Referring now to the middle situation shown in FIG. 6, VOICE B says "YES" before VOICE A says "YES". There is little overlap between the two voice commands. In this situation, the "YES" results for both voices are readily provided as shown in the waveforms identified by the reference numerals VIII and IX.

The right most situation shown in FIG. 6 illustrates the situation where VOICE B is provided as an extended "YES" and where VOICE A provides a "NO" of normal duration. In this situation, the microcontroller 21 ignores the VOX B outputs since it is greater than 200 milliseconds. Further, since the voice detection circuit 19 (which is particularly disclosed in FIG. 2) is capable of providing a VOX output as soon as the other VOX output terminates, a VOX A signal of appropriate duration will be provided by the voice detection 19. This VOX A signal will be accepted by the microcontroller 21 and will be regarded as a normal VOX input. Therefore, the microcontroller 21 will look for a fricative signal, but will not find a fricative signal since the VOICE A associated with VOX A was a "NO". Therefore, the micrcontroller 21 will provide a "NO" output as indicated in the waveform identified by their reference numeral VIII.

It should be noted with respect to the right most situation described immediately above a FRICATIVE B ENABLE signal and a fricative signal were both generated despite the fact that the microcontroller 21 ignored the VOX B input since it had exceeded the 200 millisecond limit. This is caused by the fact that the FRICATIVE B ENABLE signal is taken directly off the VOX B output, as indicated on FIG. 2. However, it should be apparent that if the FRICATIVE A ENABLE and FRICATIVE B ENABLE signals are provided by the microcontroller 21 then the microcontroller 21 would be appropriately adapted so that it would not provide a FRICATIVE ENABLE signal if it has decided to ignore a VOX input. In such a situation a fricative signal would not be provided.

Figure 7:
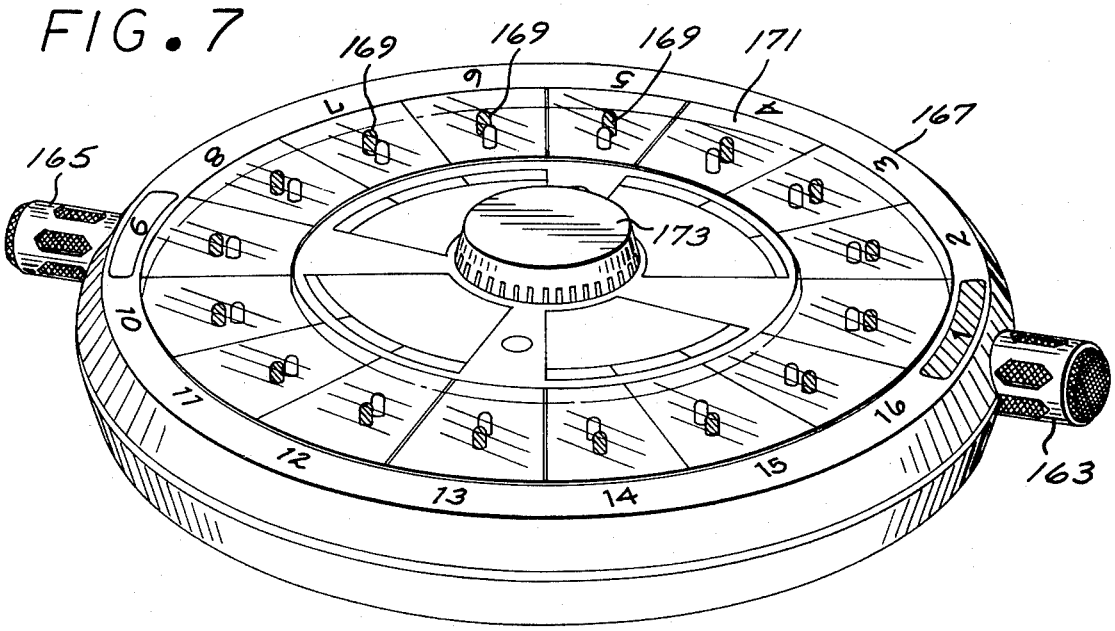
FIG. 7 is a perspective view of an exemplary housing and display field for the disclosed voice discriminating system.

FIG. 7 discloses in exemplary form a housing which shows the placement of the microphones identified by the reference numerals XI and XIII in FIG. 1, as well as the visual display elements which were discussed in conjunction with the display circuit 29. Particularly, the device of FIG. 7 includes microphones 163 and 165 which are mounted diametrically opposite each other and facing away from each other in a housing 167. As discussed previously, such an arrangement improves the discrimination between inputs provided to the microphones. This is caused by the fact that sound will first reach the microphone closest to the source. Within the housing are pairs of LED's which are placed in circular fashion. Each LED pair is generally referred to by the reference numeral 169. Each pair consists of two LED's of different colors, as shown by illustrating one of each LED pair as being shaded. The shaded LED's are associated with the microphone 163, as shown by the shaded number area adjacent the microphone 163. Of course, the non-shaded LED's are associated with the microphone 165 which has a non-shaded number area adjacent it. The LED pairs 169 are covered by a colored plastic sheet, such as a smoked plastic sheet, which is designated by the reference numeral 171. The plastic plate 171 includes radial score lines to separate areas associated with the LED pairs.

In the center of the housing 167 is a sound dispersing dome 173 with circumferentially distributed openings for enclosing the appropriate speaker of the sound circuit 31 (FIG. 1). The dome 173 is centered between the microphones 163 and 165 so that its emitted sounds effectively cancel each other in the voice detection circuit 19 (FIG. 1).

Although the foregoing has been a description of a specific embodiment of the disclosed invention, modifications and changes thereto can be made by persons skilled in the art without departing from the spirit and scope of the invention as defined by the following claims.

What is claimed is:

1. A voice discriminating system responsive to sound inputs, comprising:

first and second transducing and amplifying means responsive to spoken sounds for providing respective first and second output signals representative of the respective sound inputs provided to said first and second transducing means;

first and second low-pass filtering means respectively responsive to said first and second output signals for respectively providing first and second low-pass outputs representative of the low frequency components in said first and second outputs;

first and second peak detecting and integrating means responsive to said first and second low-pass outputs for respectively providing first and second envelope outputs as a function of said first and second low-pass outputs; means for comparing said first and second envelope outputs to provide a comparison output signal indicative of which envelope signal is larger in amplitude than the other envelope signal;

means responsive to said comparison output for preventing the peak detecting and integrating means associated with the envelope signal of lower amplitude from providing an envelope signal;

frequency detecting means responsive to said comparison output for sampling the output signal from the one of said first and second transducing and sampling means associated with the envelope signal of larger amplitude and for providing an output indicative of the presence of predetermined high frequency components in said output signal; and controller means responsive to said comparison means output and said frequency detecting means for providing an output as a function of said comparison means output and said frequency detecting means output.

2. The voice discriminating system of claim 1 wherein said first and second peak detecting and integrating means each comprises an operational amplifier, a peak detecting diode, and an integrating capacitor.

3. The voice discriminating system of claim 1 wherein said comparing means comprises first and second operational amplifiers each of which are responsive to both said first and second envelope signals.

4. The voice discriminating system of claim 1 wherein said frequency detecting means includes an operational amplifier that provides a high-pass output.

5. The voice discriminating system of claim 1 wherein said controller comprises a programmable integrated circuit microcontroller.

6. A voice discriminating system responsive to first and second signals indicative of first and second sound inputs, comprising:

means responsive to said first and second signals for comparing said first and second signals and for providing a comparison output indicative of which one of said first and second signals is of larger amplitude and exceeds the other in amplitude, said comparison output remaining for at least the time duration during which one of said first and second signals exceeds the other in amplitude;

frequency detecting means responsive to said comparison output for sampling the one of said first and second signals that caused said comparison output after the termination of said comparison output, said frequency detecting means providing an output indicative of the presence of predetermined high frequency components in the sampled sound input;

controller means responsive to said comparison output and said frequency detecting means output for providing outputs as a function of said comparison output and said frequency detecting means output, said controller means outputs also being indicative of which sound input caused said comparison output.

7. The voice discriminating system of claim 6 wherein said comparing means includes first and second operational amplifiers having cross-coupled inputs.

8. The voice discriminating system of claim 6 wherein said frequency detecting means includes an operational amplifier.

9. The voice discriminating system of claim 6 wherein said controller means comprises an integrated circuit microcontroller.

* * * * *